US006455484B1

(12) United States Patent
Gladfelter et al.

(10) Patent No.: US 6,455,484 B1
(45) Date of Patent: Sep. 24, 2002

(54) TWO PART CHEMICAL CONCENTRATE

(75) Inventors: Elizabeth J. Gladfelter, Falcon Heights, MN (US); Tina O. Outlaw, Inver Grove Heights, MN (US); James L. Copeland, Burnsville, MN (US); Rhonda K. Schulz, Burnsville, MN (US); Daniel K. Boche, Eagan, MN (US); Jeff W. Peterson, Minnetonka, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/667,487

(22) Filed: Sep. 22, 2000

Related U.S. Application Data

(63) Continuation of application No. 08/071,596, filed on Jun. 4, 1993, now Pat. No. 6,211,129, which is a continuation of application No. 07/699,662, filed on May 14, 1991, now abandoned.

(51) Int. Cl.[7] ..... C11D 17/00

(52) U.S. Cl. ..... 510/294; 510/220; 510/224; 510/225; 510/226; 510/229; 510/232; 510/233; 510/276; 510/298; 510/447; 510/438; 510/440; 510/445

(58) Field of Search ..... 510/220, 224, 510/225, 226, 229, 232, 233, 276, 298, 447, 438, 440, 445, 294

(56) References Cited

U.S. PATENT DOCUMENTS

| | | | | |
|---|---|---|---|---|
| 683,181 | A | 9/1901 | Mereness | 252/90 |
| 692,481 | A | 2/1902 | Robinson | 252/90 |
| 1,267,949 | A | 5/1918 | Williams | 252/90 |
| 1,854,235 | A | 4/1932 | Stoddard | 252/93 |
| 3,198,740 | A | 8/1965 | Dunlop et al. | 252/90 |
| 3,546,716 | A | 12/1970 | Lauman | 4/112 |
| 3,661,695 | A | 5/1972 | Berliner | 161/151 |
| 3,790,067 | A | 2/1974 | Scheier | 229/55 |
| 3,892,905 | A | 7/1975 | Albert | 428/220 |
| 3,925,225 | A | 12/1975 | Morrison | 252/90 |

(List continued on next page.)

FOREIGN PATENT DOCUMENTS

| | | | |
|---|---|---|---|
| CH | 2465 | 5/1890 | |
| DE | 888588 | 9/1933 | |
| DE | 3017246 A1 | 5/1980 | |
| DE | 3541146 | 5/1987 | 252/90 |
| EP | 0010171 | 9/1979 | |

(List continued on next page.)

OTHER PUBLICATIONS

Japanese Patent Application No. 2163149–A to Kao Corp. (Abstract Only), No date.
Japanese Patent Application No. 2155999–A to Proctor & Gamble (Abstract Only), No date.
Japanese Patent Application No. 2108534–A to Kao Corp. (Abstract Only), No date.
Japanese Patent Application No. 2060906–A to Kao Corp. (Abstract Only).
Air Products Product Literature, No date.

(List continued on next page.)

*Primary Examiner*—Charles Boyer
(74) *Attorney, Agent, or Firm*—Merchant & Gould P.C.

(57) ABSTRACT

The invention is a solid chemical concentrate system of at least two cooperative shapes. The first shape is an inwardly curved bar having an inner opening. The second shape is an insert which is capable of interlocking with the bar by insertion into the bar inner opening. The solid chemical concentrate provides chemical systems having active constituents which may be the same, different but compatible or functionally and chemically incompatible combined within one matrix to provide at least one substantially continuous surface. The system may also comprise an aqueous soluble or dispersible polymeric film cover.

14 Claims, 2 Drawing Sheets

U.S. PATENT DOCUMENTS

| | | | | | |
|---|---|---|---|---|---|
| 4,372,311 | A | | 2/1983 | Potts | 128/287 |
| 4,551,369 | A | | 11/1985 | Belz | 428/36 |
| 4,569,780 | A | * | 2/1986 | Fennholz et al. | 252/90 |
| 4,612,355 | A | | 9/1986 | Belz | 428/36 |
| 4,620,999 | A | | 11/1986 | Holmes | 428/35 |
| 4,672,956 | A | | 6/1987 | Potter et al. | 128/90 |
| 4,683,072 | A | | 7/1987 | Holdt | 252/174 |
| 4,762,738 | A | | 8/1988 | Keyes et al. | 428/36 |
| 4,772,663 | A | | 9/1988 | Marten | 525/60 |
| 4,828,744 | A | | 5/1989 | Kaufmann et al. | 252/90 |
| 4,828,745 | A | * | 5/1989 | Jeschke et al. | 252/99 |
| 4,828,749 | A | * | 5/1989 | Kruse et al. | 252/135 |
| 4,835,804 | A | | 6/1989 | Arnav-Munoz et al. | 252/90 |
| 4,851,472 | A | | 7/1989 | Famili et al. | 525/60 |
| 4,870,148 | A | | 9/1989 | Belz | 526/318.41 |
| 4,930,942 | A | | 6/1990 | Keyes et al. | 406/49 |
| 4,942,973 | A | | 7/1990 | Bowie | 252/90 |
| 4,944,165 | A | | 7/1990 | Leebeek et al. | 252/90 |
| 4,948,857 | A | | 8/1990 | Marten et al. | 525/60 |
| 4,973,416 | A | | 11/1990 | Kennedy | 252/90 |
| 4,990,146 | A | | 2/1991 | Diebig et al. | 604/332 |
| 5,108,807 | A | | 4/1992 | Tucker | 428/35.2 |
| 5,133,892 | A | * | 7/1992 | Chun et al. | 252/90 |
| 5,198,140 | A | * | 3/1993 | Joshi et al. | 252/90 |
| 5,234,615 | A | | 8/1993 | Gladfelter | 252/90 |

FOREIGN PATENT DOCUMENTS

| | | | | |
|---|---|---|---|---|
| EP | 0055100 | | 6/1982 | |
| EP | 0142950 | | 10/1984 | |
| EP | 0176163 | | 4/1986 | |
| EP | 0226439 | | 12/1986 | |
| EP | 0245760 | | 11/1987 | 252/90 |
| EP | 0284191 | | 2/1988 | |
| FR | 2258157 | | 9/1975 | |
| GB | 7935 | | of 1898 | |
| GB | 1384791 | | 4/1972 | |
| GB | 2083762 | B | 2/1985 | |
| JP | 57497 | | 3/1987 | |
| JP | 62060644 | | 3/1987 | |
| JP | 2258899 | | 10/1990 | 252/90 |
| JP | 3124734 | | 5/1991 | |
| NZ | 205598 | | 3/1987 | |
| SE | 578617 | | 8/1976 | |

OTHER PUBLICATIONS

*Vinol™ Polyvinyl Alcohols,* Air–Products, No date.

*Vinex™ Thermoplastic Polyvinyl Alcohol Copolymer Resins,* Air Products, No date.

Amir Famili et al, "Novel Thermoplastic Polyvinyl Alcohol Copolymer", No date.

Aquafilm limited Product Literature, "Water Soluble Films", No date.

*Belland Plastics Literature* , No date.

Database, WPIL, Section Ch, Derwent Publications Ltd., London, GB; Class D21, AN 90–193717 & ZA,A,8 907 717 (Colgate–Palmolive) Nov. 2, 1988.

*Polyox Water–Soluble Resins,* Union Carbide Corporation, No date.

* cited by examiner

TWO PART CHEMICAL CONCENTRATE

"This application is a continuation of application Ser. No. 08/071,596, filed Jun. 4, 1993, now U.S. Pat. No. 6,211,129 which is a Continuation of 07/699,662 filed May 14, 1991 (now abandoned) which application(s) are incorporated herein by reference."

FIELD OF THE INVENTION

This invention relates generally to chemical concentrate systems which may dispense compatible or incompatible actives in one or more systems. More specifically, the invention relates to a chemical concentrate system of at least two cooperative shapes which may provide at least one substantially continuous surface for contact by an aqueous spray wherein the two cooperative shapes may comprise active chemicals which are either substantially similar, or completely different being either functionally compatible or incompatible. The solid chemical concentrate system may include warewashing or laundry detergents, bleaching agents, sanitizers, presoaks, surface cleaners and floor cleaners, as well as any number of other chemical detergent systems useful in any variety of applications.

BACKGROUND OF THE INVENTION

Institutional cleaning environments often require the use of various chemicals given the nature of problems which arise. At times the various active chemicals are functionally different and may even be chemically incompatible. As a result, extended preparation and packaging alternatives must often be considered. In applications such as warewashing, laundry washing, hard surface cleaning, sanitizing, pot and pan, presoaking, any number of active ingredients may be used which in any given instance may or may not be chemically or functionally compatible with a procedure which is to be performed prior to, during, or after, the active ingredient is applied.

As a result, there is a need to develop a means of manufacturing, packaging, and storing active chemical ingredients of varying strength, activity, or application. One means of providing such an invention is by enveloping or coating the composition with a film. However, many detergent chemicals are not compatible with any number of film systems. For example, these polymers may not generally be compatible with chemical systems having certain active ingredients such as halogens or high alkalinity.

Chemical detergents, cleaners, and the like must also be generally contained in a system which combines strength and structural integrity with storage stability to contain the product during storage and transportation prior to reaching its final end use. At the final location the package must have enough strength to withstand handling prior to use.

Finally, many chemical cleaners have a highly alkaline nature or contain constituents such as chlorine sources which are undesirable to contact. Operational handling of these compositions, especially in the environment of use, often creates definite hazards stemming from, for example, the premature creation of high pH solutions which may result in severe injury to the operator.

As a result, a need still exists for a cleaning system which may be able to provide active chemicals of varying concentrations or maintain chemicals which are functionally or chemically incompatible in one uniform matrix through the design of the system.

SUMMARY OF THE INVENTION

The invention is a solid chemical concentrate system of at least two cooperative shapes. The first shape is an inwardly curved bar having an inner opening. The second shape is an insert which interlocks with the bar by fitting within the inner opening. When used together, the bar and insert may provide at least one substantially continuous surface for contact by an aqueous spray.

One aspect of the invention is a combination of active ingredients between the two shapes which provide desired enhanced functional characteristics. Another aspect of the invention is the ability to provide varying volumes of actives which, although compositionally different, serve complementary functions in final use. A further aspect of the invention is to provide more than one active which, although functionally and/or chemically incompatible, are included together in one system. An additional aspect of the invention is the use of water soluble and/or dispersible films which may be used to seal the various parts of system either together or separately.

We have discovered a versatile product shape that allows the addition of an insert which may increase the performance of the original product, and allow for the packaging of incompatible chemicals. Incompatibility refers to chemicals which are incompatible due to manufacturing process conditions, storage conditions, or general functional and chemical incompatibility.

The invention may be used as a cast solid or may be packaged in a water soluble or dispersible container. Moreover, the two piece cooperative chemical concentrate system may contain products that are cast, compressed, or pelletized. Physical states may be altered due to chemical activity or compatibilities, dispensing and use rates, and other performance requirements as needed in the final site of application. Furthermore, the size ratio of the two solid pieces may be varied according to the specific end use requirements.

For example, detergents and rinse additives are two products that are often used in conjunction in a similar environment. These two products can be packaged together and then separated prior to use at the final point of application. Other cleaning systems which lend themselves to the invention include pot and pan detergents used in conjunction with sanitizers as well as pot and pan detergents used in conjunction with presoaks. In all cases the ratio of the two products depends in part on the use rates of the products.

Additionally, we have discovered that the use of a water soluble container or film significantly reduces the total amount of packaging materials associated with these products.

We have discovered a means for storing and dispensing products in water soluble films which provides stability, packaging of high structural integrity, and handling protection for operators prior to use even when used with any number of actives or high alkalis. The film may be made into a package useful for containing any number of cleaning or detergent chemicals in granular, compressed, pelletized, or extruded solid form, or cast solid form. Any application that requires a cleaning product, for example, laundry, clean in place, bottle washing applications, etc., may use this cleaning system. This system is designed for single use or multiple use applications and the ultimate use solution may be prepared manually or by way of a dispensing unit.

DETAILED DESCRIPTION OF THE PREFERRED EMBODIMENTS

We have discovered a solid chemical concentrate system having at least two cooperative shapes. The invention may also combine detergent compositions with an aqueous soluble or dispersible polymeric film. The term detergent compositions should be interpreted to include any rinsing, cleaning, conditioning, antimicrobial, etc. chemical or other solid composition which has an active ingredient intended for the ultimate application and which may conveniently be packaged in the polymeric film of the invention. Generally, the composition of the invention may include any active chemical agent along with a hardening agent. Optionally, the composition of the invention may also include sequestrants, sanitizing and disinfectant agents, surfactants and any variety of other formulatory. and application adjuvants.

The Block Structure

Generally, in its preferred mode, the invention provides a chemical concentrate system capable of combining two cooperating shapes towards ultimately providing one substantially continuous surface for contact by an aqueous spray. This substantially continuous surface may generally comprise the first shape as well as the second shape in order to define a use solution having active constituents from both shapes.

Generally, the function of the invention is to provide a concentrate system which allows manufacture, packaging, storage, and use of chemicals having variable concentration, functional incompatibility, or chemical incompatibility in a single system. For example, the first and second shapes may comprise the same active ingredient. When similar or the same active ingredients are used between the two shapes, the insert may be used to substantially increase the concentration of active ingredient provided to any single given application.

In instances where the active constituent in the first shape and the active constituent in the second shape are different, the invention may be used to package these chemicals in a manufacturing, storage, and use stable manner to prevent chemical reaction and/or compromise of these materials. Finally, where the actives between the two shapes are distinct and functionally incompatible, the invention may be used as a means of transporting both actives to a given site of application and ultimately separating these actives and placing them into distinct dispensers for use in a distinct application.

Generally, the invention comprises a chemical concentrate system of at least two cooperative shapes. In accordance with the invention, the concentrate system may take any variety of three dimensional configurations including cylindrical, cubic, spherical, and the like.

Preferably, the chemical concentrate system takes the configuration shown in FIGS. 1–6.

Figure 1:
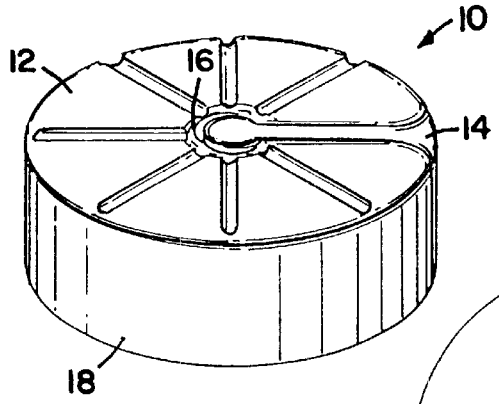
FIG. 1 is a perspective view of one embodiment of the invention.
Figure 3:
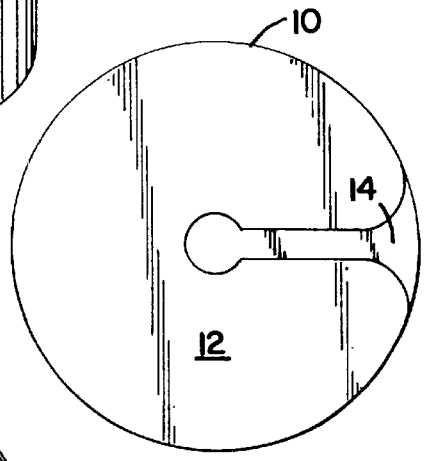
FIG. 3 is a bottom plan view of the invention shown in FIG. 1.
Figure 2:
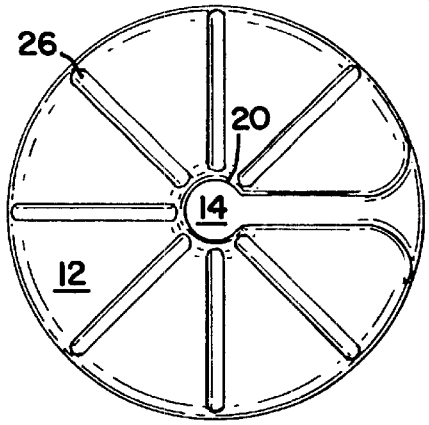
FIG. 2 is a top plan view of the invention shown in FIG. 1.

The solid chemical concentrate system generally has two cooperative shapes 12, 14. The first shape 12 may preferably be configured as an inwardly curved bar having an inner opening 16. The second shape 14 is preferably configured as an insert which interlocks with the bar 12 by fitting in the bar inner opening 16. As can be seen in FIGS. 2 and 3 the top surface (FIG. 2) and the bottom surface (FIG. 3) provide substantially planar areas for contact by a diluent spray. In use, the bar 12 and insert 14 provide at least one substantially continuous surface 24 or 28 for contact by an aqueous spray, FIG. 4.

Figure 4:
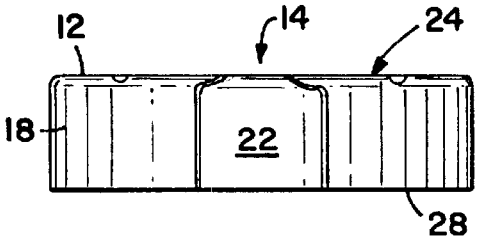
FIG. 4 is a first side elevational view showing the invention depicted in FIG. 1 at that point of the invention side wall where the insert and circular bar intersect.
Figure 5:
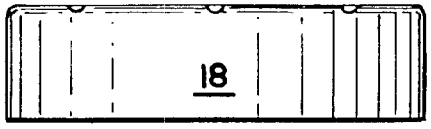
FIG. 5 is a second side elevational view showing the block side wall structure.
Figure 6:
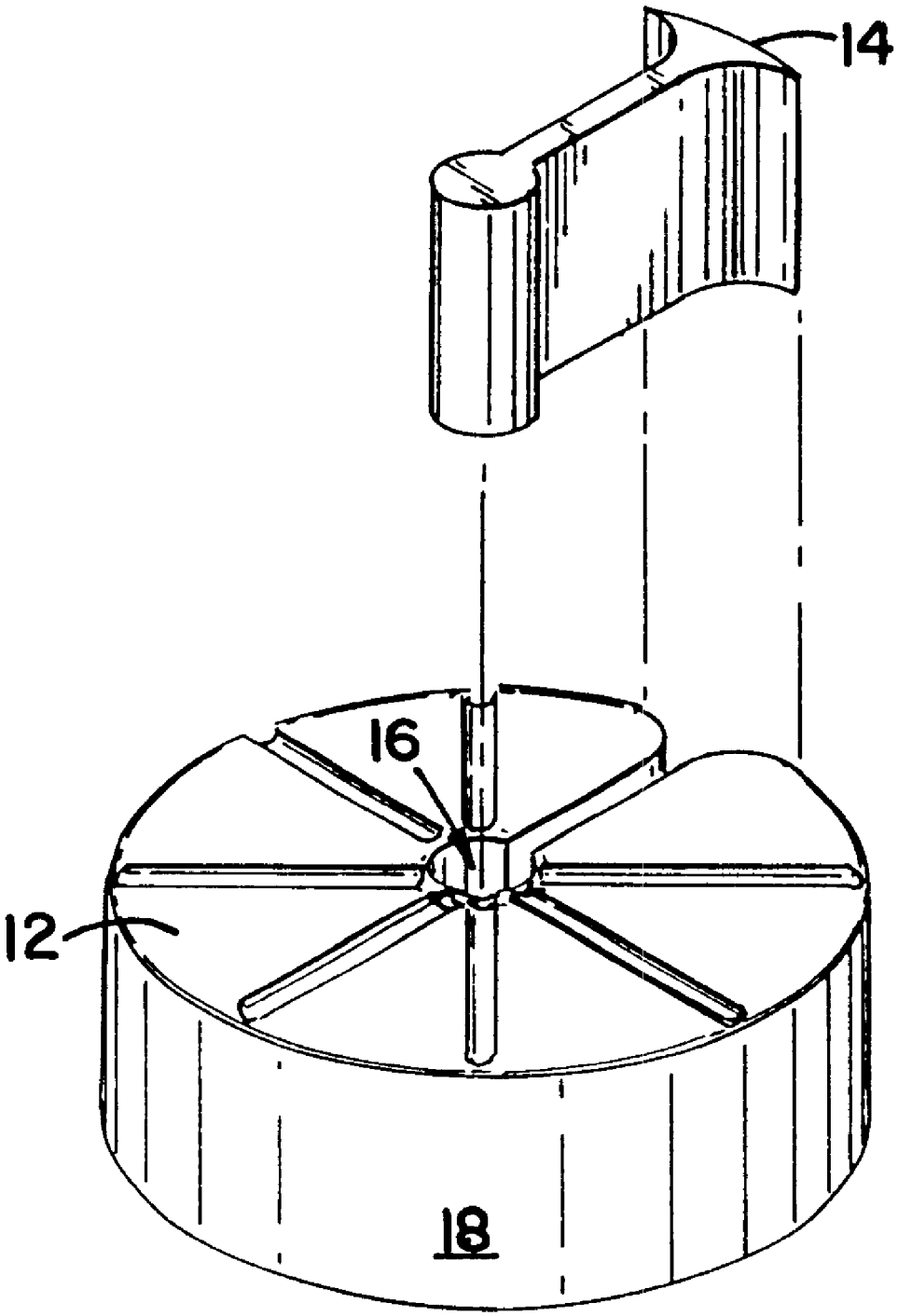
FIG. 6 is an exploded perspective view of the invention shown in FIG. 1.

More specifically, bar 12 is a three dimensional shape having an outer circular wall 18 and an inner circular wall 20 which defines the inner opening 16, FIGS. 2 and 4.

Preferably, the inner wall 20 and said outer wall 18 adjoin and run into each other. In this configuration, the interlocking insert 14 has substantially the same volume as the inner opening 16, FIG. 2.

As can be seen in FIG. 3, the outer wall 22 of insert 14 may preferably run continuous with the outer wall 18 of the circular bar 12. This provides for a circular parameter and completes the cylindrical shape of the bar. The concentrate system also preferably has grooves 26 across its upper surface 24. Generally, these grooves 26 may take any variety of patterns. As shown, the grooves 26 project radially outward across the flat upper surface 24 of the concentrate bar 12 spanning across the surface from the inner wall 20 of the bar to the outer wall 18 of the bar. The grooves function to provide areas where water may pool in order to provide uniform dissolution of the concentrate system.

Alternatively, the concentrate system of the present invention may comprise an outer film lining which is continuous over both the first and the second shapes. Further, this continuous outer film lining may be used to autonomously cover each of the shapes independently so that the shapes may be separated and dispensed independently.

Compositional Form and Shape

The alkaline chemical compositions used in the claimed system may take any number of forms including granular, compressed solid, or cast solid. Granular solids may include any particle solids ranging in diameter from microns to centimeters. These granular solids may be formed through any variety of means known to those of skill in the art.

Compressed solids include solids formed by processes such as extrusion, tableting, pelletizing and the like known to those of skill in the art. Compressed solids may range in mass from under an inch to several inches in diameter. Cast solids are materials which are cast by processes known to those of skill in the art and generally range in size from several inches to larger blocks of 8 to 10 inches or more.

Solids used in the invention may be homogeneous or nonhomogeneous. Homogeneous indicates that the solid mass has an even and uniform chemical and physical mixture of constituents. Nonhomogeneous indicates that the solid mass may have an uneven or nonuniform chemical or physical makeup. For example, a nonhomogeneous mass may comprise a solid detergent cleaner containing a nonionic surfactant and encapsulated chlorine granules. The incompatibility of the nonionic surfactant and the chlorine generally necessitate the encapsulation of the chlorine which, when mixed in the solid, constitute granules or encapsulates of different chemical composition and physical size than the solid mass in general.

The physical form of the cast and compressed solids may take any general form conducive to dispensing manually or through mechanical or electromechanical machine.

Active Ingredients

The present composition may comprise anynumber of active ingredients including alkaline or caustic agents, surfactants, sequestrants, bleaching and antimicrobial agents and the like.

A. Source of Alkalinity

In order to provide an alkaline pH, the composition may comprise an alkalinity source. One aspect of the present invention provides for the use of aqueous soluble polymeric films with highly alkaline compositions without chemical or physical degradation of the films. The concentration of alkaline agent may vary considerably. However, alkaline cleaners may have a pH of the ranging from about 8 to 14, preferably from about 9 to 12, and most preferably from about 10 to 12.

An alkaline pH increases the efficacy of the chemical breakdown when the chemical is placed in use and facilitates the rapid dispersion of soils. The general character of the alkalinity source is only to those chemical compositions which have a greater solubility. Exemplary alkalinity sources include silicates, hydroxides, and carbonates.

Silicates useful in accord with this invention include alkali metal ortho, meta-, di-, tri-, and tetrasilicates such as sodium orthosilicate, sodium sesquisilicate, sodium sesquisilicate pentahydrate, sodium metasilicate, sodium metasilicate pentahydrate, sodium metasilicate hexahydrate, sodium metasilicate octahydrate, sodium metasilicate nanohydrate, sodium disilicate, sodium trisilicate, sodium tetrasilicate, potassium metasilicate, potassium metasilicate hemihydrate, potassium silicate monohydrate, potassium disilicate, potassium disilicate monohydrate, potassium tetrasilicate, potassium tetrasilicate monohydrate, or mixtures thereof.

Generally, when a silicate compound is used as the alkalinity source in the present invention, the concentration of the silicate will range from about 5 wt-% to 60 wt-%, preferably from about 10 wt-% to 50 wt-%, and most preferably from about 25 wt-% to 45 wt-%.

Alkali metal hydroxides have also been found useful as an alkalinity source in the present invention. Alkaline hydroxides are generally exemplified by species such as potassium hydroxide, sodium hydroxide, lithium hydroxide, and the like. Mixtures of these hydroxide species may also be used. While in present, the alkaline hydroxide concentration generally ranges from about 5 wt-% to about 85 wt-%, preferably from about 15 wt-% to 70 wt-%, and most preferably from about 30 wt-% to 60 wt-%.

An additional source of alkalinity includes carbonates. Alkaline carbonates which may be used in the invention include alkali and alkali earth metal carbonates, bicarbonates, and sesquicarbonates. When carbonates are used, potassium or sodium carbonates are preferred. When carbonates are used the concentration of these agents generally ranges from about 5 wt-% to 70 wt-%, preferably from about 10 wt-% to 55 wt-%, and most preferably from about 20 wt-% to 40 wt-%.

B. Sequestrants

In order to prevent the formation of precipitates or other salts, the composition of the present invention may generally comprise builders, chelating agents or sequestrants.

Generally, sequestrants are those molecules capable of coordinating the metal ions commonly found in service water and thereby preventing the metal ions from interfering with the functioning of detersive components within the composition. The number of covalent bonds capable of being formed by a sequestrant upon a single hardness ion is reflected by labeling the sequestrant as bidentate (2), tridentate (3), tetradendate (4), etc. Any number of sequestrants may be used in accordance with the invention. Representative sequestrants include salts of amino carboxylic acids, phosphonic acid salts, water soluble acrylic polymers, among others.

Suitable amino carboxylic acid chelating agents include n-hydroxyethyliminodiacetic acid, nitrilotriacetic acid (NTA), ethylenediaminetetraacetic acid (EDTA), hydroxyethyl-ethylenediaminetriacetic acid (HEDTA), and diethylenetriaminepentaacetic acid (DTPA). When used, these amino carboxylic acids are generally present in concentrations ranging from about 1 wt-% to 25 wt-%, preferably from about 5 wt-% to 20 wt-%, and most preferably from about 10 wt-% to 15 wt-%.

Other suitable sequestrants include water soluble acrylic polymer to condition the wash solutions under end use conditions. Such polymers include polyacrylic acid, polymethacrylic acid, acrylic acid-methacrylic acid copolymer, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, or mixtures thereof. Water soluble salts or partial salts of these polymers such as these respective alkali metal (for example, sodium or potassium) or ammonium salts can also be used.

The weight average molecular weight of the polymers is from about 4000 to about 12000. Preferred polymers include polyacrylic acid, the partial sodium salts of polyacrylic acid or sodium polyacrylate having an average molecular weight within the range of 4000 to 8000. These acrylic polymers are generally useful in concentrations ranging from about 0.5 wt-% to 20 wt-%, preferably from about 1 wt-% to 10 wt-%, and most preferably from about 1 wt-% to 5 wt-%.

Also useful as sequestrants are phosphonic acids and phosphonic acid salts. In addition to conditioning the water, organic phosphonic acids and phosphonic acid salts provide a grease dispersing character. Such useful phosphonic acids include, mono, di, tri and tetraphosphonic acids which can also contain groups capable of forming anions under alkaline conditions such as carboxy, hydroxy, thio and the like. Among these are phosphonic acids having the formula $R_1N[C_2PO_3H_2]_2$ or $R_2C(PO_3H_2)_2OH$ wherein $R_1$ may be –[(lower) alkylene]$N[CH_2PO_3H_2]_2$ or a third $C_2PO_3H_2$) moiety; and wherein $R_2$ is selected from the group consisting of $C_1$–$C_6$ alkyl.

The phosphonic acid may also comprise a low molecular weight phosphonopolycarboxylic acid such as one having about 2–4 carboxylic acid moieties and about 1–3 phosphonic acid groups. Such acids include 1-phosphono-1-methylsuccinic acid, phosphonosuccinic acid and 2-phosphonobutane-1,2,4-tricarboxylic acid.

When used as a sequestrant in the invention, phosphonic acids or salts are present in a concentration ranging from about 0.25 wt-% to 15 wt-%, preferably from about 1 wt-% to 10 wt-%, and most preferably from about 1 wt-% to 5 wt-%.

C. Surfactants

Another active ingredient which may be used with the invention are surfactants or surface tension altering compounds or polymers. Specifically, surfactants function to alter surface tension in the resulting compositions, provide sheeting action, assist in soil removal and suspension by emulsifying soil and allowing removal through a subsequent flushing or rinse. Any number of surfactants may be used including organic surfactants such as anionic surfactants, zwitterionic surfactants, amphoteric surfactants, cationic surfactants and nonionic surfactants.

Anionic surfactants are useful in removing oily soils. Generally, anionic surfactants have a more hydrophobic nature which allows their use in warewashing and laundry operations intent on cleaning objects with oil sediments.

Oil soils do not tend to be as alkaline sensitive as other types of sediment. As a result, anionic surfactants are often used to boost the cleaning efficacy of alkaline warewashing and laundry detergents.

Anionic surfactants include alkyl carboxylates, such as sodium and potassium carboxylates, alkyl sulfates, alkyl ether sulfates, alkyl benzene sulfonates, alkyl sulfonates, sulfonated fatty acid esters and the like.

Amphoteric or zwitterionic surfactants are also useful in providing detergency, emulsification, wetting and conditioning properties. Representative amphoteric surfactants include N-coco-3-aminopropionic acid and acid salts, N-tallow-3-iminodiproprionate salts. As well as N-lauryl-3-iminodiproprionate disodium salt, N-carboxymethyl-N-cocoalkyl-N-dimethylammonium hydroxide, N-carboxymethyl-N-dimethyl-N-(9-octadecenyl) ammonium hydroxide, (1-carboxyheptadecyl) trimethylammonium hydroxide, (1-carboxyundecyl) trimethylammonium hydroxide, N-cocoamidoethyl-N-hydroxyethylglycine sodium salt, N-hydroxyethyl-N-stearamidoglycine sodium salt, N-hydroxyethyl-N-lauramido-β-alanine sodium salt, N-cocoamido-N-hydroxyethyl-β-alanine sodium salt, as well as mixed alicyclic amines, and their ethoxylated and sulfated sodium salts, 2-alkyl-1-carboxymethyl-1-hydroxyethyl-2-imidazolinium hydroxide sodium salt or free acid wherein the alkyl group may be nonyl, undecyl, or heptadecyl. Also useful are 1,1-bis(carboxymethyl)-2-undecyl-2-imidazolinium hydroxide disodium salt and oleic acid-ethylenediamine condensate, propoxylated and sulfated sodium salt. Amine oxide amphoteric surfactants are also useful. This list is by no means exclusive or limiting.

Also useful as active surfactants in the present invention are nonionic surfactants. Nonionic surfactants are generally used in rinse additives to increase the sheeting action of the particular composition in warewashing applications. Nonionic surfactants which are useful in the invention include polyoxyalkylene nonionic detergents such as $C_{8-22}$ normal fatty alcohol-ethylene oxides or propylene oxide condensates, (that is the condensation products of one mole of fatty alcohol containing 8–22 carbon atoms with from 2 to 20 moles of ethylene oxide or propylene oxide); polyoxypropylene-polyoxyethylene condensates having the formula $HO(C_2H_4O)_x(C_3H_6O)_yH$ wherein $(C_2H_4O)_x$ equals at least 15% of the polymer and $(C_3H_6O)_y$ equals 20–90% of the total weight of the compound; alkylpolyoxypropylene-polyoxyethylene condensates having the formula $RO—(C_3H_6O)_x(C_2H_4O)_yH$ where R is a $C_{1-15}$ alkyl group and x and y each represent an integer of from 2 to 98; polyoxyalkylene glycols; butyleneoxide capped alcohol ethoxylate having the formula $R(OC_2H_4)_{y(OC4}H_9)_xOH$ where R is a $C_{8-18}$ alkyl group and y is from about 3.5 to 10 and x is an integer from about 0.5 to 1.5; benzyl ethers of polyoxyethylene and condensates of alkyl phenols having the formula $R(C_6H_4)(OC_2H_4)_xOCH_2C_6H_5$ wherein R is a $C_{6-20}$ alkyl group and x is an integer of from 5 to 40; and alkyl phenoxy polyoxyethylene ethanols having the formula $R(C_6H_4)(OC_2H_4)_xOH$ wherein R is a $C_{8-20}$ alkyl group and x is an integer from 3 to 20.

Preferably, nonionics such as nonyl phenol ethoxylates, and linear alcohol ethoxylates may be used in the invention.

Cationic surfactants may also be used including quaternary ammonium compounds. Also useful as antimicrobials in the invention are cationic surfactants including quaternary ammonium chloride surfactants such as N-alkyl($C_{12-18}$) dimethylbenzyl ammonium chloride, N-tetradecyldimethylbenzyl ammonium chloride monohydrate, N-alkyl($C_{12-14}$) dimethyl 1-napthylmethyl ammonium chloride available commercially from manufacturers such as Stepan Chemical Company.

D. Bleach Sources

The detergent composition of the invention may also comprise an active bleaching source. Bleaches suitable for use as detergent compositions include any of the well known bleaching agents capable of removing stains from such substrates as dishes, flatware, pots and pans, textiles, countertops, appliances, flooring, etc. without significantly damaging the substrate. A nonlimiting list of bleaches includes hypochlorites, chlorides, chlorinated phosphates, chloroisocyanates, chloramines, etc.; and peroxide compounds such as hydrogen peroxide, perborates, percarbonates, etc. Generally, if the application requires a color sensitive active agent, bleaches such as peroxide compounds are generally preferred. However, if the application does not require color sensitivity, halogen bleaches may be used.

Preferred bleaches include those bleaches which liberate an active halogen species such as chlorine, bromine, hypochlorite ion, hypobromide ion, under conditions normally encountered in typical cleaning processes. Most preferably, the bleaching agent releases chlorine ion or hypochlorite. A nonlimiting list of useful chlorine releasing bleaches includes calcium hypochlorite, lithium hypochlorite, chlorinated trisodium phosphate, sodium dichloroisocyanurate, chlorinated trisodium phosphate, sodium dichloroisocyanurate, potassium dichloroisocyanurate, pentaisocyanurate, trichloromelamine, sulfondichloroamide, 1,3-dichloro,5,5-dimethyl hydantoin, N-chlorosuccinimide, N,N'-dichloroazodicarbonimide, N,N'-chloroacetalurea, N,N'-dichlorobiuret, trichlorocyanuric acid, and hydrates thereof.

Because of their higher activity and higher bleaching efficacies, the most preferred bleaching agents are the alkylene metal salts of dichloroisocyanurate and hydrates thereof.

Generally, when present the actual concentration of bleach source or agent (in wt-% active) bleaching agents may comprise about 0.5 to 20 wt-%, preferably about 1 to 10 wt-%, and most preferably about 2 to 8 wt-% of the composition.

E. Enzymes

The invention may also comprise enzymes. Generally, depending on the application, the composition may comprise enzymes capable of hydrolyzing proteins, proteases, enzymes of capable of hydrolyzing starch (amylases), enzymes capable of hydrolyzing fibers (cellulases), enzymes which are capable of hydrolyzing fats and oils (lipases/phospholipases), enzymes that reduce or oxidize molecules (redox enzymes), or enzymes that rearrange molecules (isomerases).

Proteases are enzymes that hydrolyze peptide bonds in protein. The basic building blocks of protein polymers are amino acids. Amino acids can be joined to form peptide chains. The linkage between each amino acid is called a peptide bond. Proteases split peptide bonds with water by one of two modes. Exoproteases cleave off single amino acids from either end of a peptide chain. Endoproteases attack the interior peptide bonds of a protein chain. The hydrolysis products of such a mode of attack are usually the smaller polypeptides and peptides.

Amylases are enzymes that catalyze or accelerate the hydrolysis of starch. Native starch is a polymer made up of glucose molecules linked together to form either a linear polymer called amylose or a branched polymer called amylopectin. Several of the enzymes which are capable of hydrolyzing the starch include alpha-amylase which results in a hydrolysis products having the alpha configuration by randomly cleaving internal bonds to yield shorter water soluble starch chains. Beta-amylases are also used to cleave 1–4 bonds by attacking the ends of the starch to split off maltose or disaccharide sugars in a stepwise manner from one end of the starch polymer. Other amylases include fungal amylase, amyloglucosidase, pullulanase, and others.

Cellulases may also be included in the composition of the invention. Cellulases are capable of hydrolyzing fibers such as cellulose. Cellulose is a linear glucose polymer coupled by beta (1–4) bonds. These enzymes can attack cellulose via two modes. Endocellulases are capable of hydrolyzing the beta (1–4) bonds randomly along the cellulose chains. Exocellulases cleave off glucose molecules from one end of the cellulose strand. Generally, cellulases and other enzymes that hydrolyze fiber may be used in the invention including cellulases generally, hemicellulases, beta-glucanses, pectinases, and the like.

Other useful enzymes include redox enzymes such as glucose oxidase, catalase, and lipoxidase; enzymes that hydrolyze fats and oils such as lipases, phospholipases, and the like.

Depending upon the application, any number of enzymes may be used in the present composition. Notably, in laundry washing and care compositions, cellulases generally are used to hydrolyze fibers and prevent common pilling which often occurs after extended washings. In warewashing compositions, enzymes such as amylases are used to assist in solubilizing proteinaceous soils. Generally, depending on the ultimate application and other constituents which may be present in the composition, the composition should be monitored to ensure proper pH as well as prevent the inadvertent combination of the enzyme source with constituents which may compromise its effectiveness such as bleaches. Generally, if present, enzymes may have a concentration ranging from about 2 wt-% to 25 wt-%, preferably from about 5 wt-% to 20 wt-%, and most preferably from about 10 wt-% to 15 wt-%.

F. Antimicrobial Agents

Generally, any solid or liquid chemical agent which may be solidified having microbicidal efficacy may be used in the invention. Chemical compositions known to impart microbicidal efficacy include aldehydes, iodophors, phenolics, surfactants including anionic and cationic surfactants, and inorganic or organic chlorine releasing agents.

Representative compositions which could be used as antimicrobial agents in the invention include commonly available aldehydes such as formaldehyde and glutaraldehyde; iodophors such as iodine-nonionic surfactant complexes, iodine-polyvinyl pyrrolidone complexes, iodine-quaternary ammonium chloride complexes and amphoteric iodine-amine oxide complexes and the like; organic chlorine releasing agents such as cyanurates, cyanuric acids, and dichlorocyanuric dihydrates which are commercially available from FMC and Monsanto as their CDB and ACL product lines, respectively; encapsulated or unencapsulated inorganic chlorine releasing agents such as alkali, and alkaline earth hypochlorites including NaOCl, KOCl, LiOCl, $Ca(OCl)_2$ and the like; fatty acids such as decanoic acid and the like; anionic surfactants such as dodecylbenzene sulfonic acid and sodium 1-octane sulfonate; phenols such as o-phenylphenol, 2,4,5-trichlorophenol, and 2,3,4,6-tetrachlorophenol commercially available from sources such as Dow Chemical Company and Mobay Chemical Company. Also useful as antimicrobials in the invention are cationic surfactants including quaternary ammonium chloride surfactants such as N-alkyl($C_{12-18}$) dimethylbenzyl ammonium chloride, N-alkyl($C_{14-18}$) dimethylbenzyl ammonium chloride, N-tetradecyldimethylbenzyl ammonium chloride monohydrate, N-alkyl($C_{12-4}$) dimethyl 1-napthylmethyl ammonium chloride available commercially from manufacturers such as Stepan Chemical Company.

When present, an antimicrobial agent must have a concentration effectively necessary for the required action to be provided. Generally, the concentration of antimicrobial agent may range from about 5 to 70 wt-%, preferably from about 10 to 50 wt-%, and most preferably from about 20 to 40 wt-%.

Solidifying Agent

The invention may also comprise a solidifying agent. Generally, any agent or combination of agents which provides a requisite degree of solidification in aqueous solubility may be used with the invention. A solidifying agent may be selected from any organic or inorganic compound which imparts a hardness and/or controls the soluble character of the present composition when placed in an aqueous environment.

Compositions which may be used with the present invention to vary solid character and solubility include amides such as stearic monoethanolamide, lauric diethanolamide, and stearic diethanolamide.

Nonionic surfactants have also been found to impart varying degrees of solidity and solubility when combined with a coupler such as propylene glycol or polyethylene glycol. Nonionics useful in this invention include nonylphenol ethoxylates, linear alkyl alcohol ethoxylates, ethylene oxide/propylene oxide block copolymers such as the Pluronic™ surfactants commercially available from BASF Wyandotte.

Nonionic surfactants particularly desirable as hardeners are those which are solid at room temperature and have an inherently reduced aqueous solubility as a result of the combination with the coupling agent.

Other surfactants which may be used as solidifying agents include anionic surfactants which have high melting points to provide a solid at the temperature of application. Surfactants of choice also allow varying degrees of aqueous solubility. Anionic surfactants which have been found most useful include linear alkyl surfactants.

Other compositions which may be used as hardening agents with the composition of the invention include urea, also known as carbamide, and starches which have been made water soluble through an acid or alkaline treatment. Also useful are various inorganics which either impart solidifying properties to the present composition and can be processed into pressed tablets for carrying the alkaline agent. Such inorganic agents include calcium carbonate, sodium sulfate, sodium bisulfate, alkali metal phosphates, anhydrosodium acetate and other known hydratable compounds.

Solidifying agents may be used in concentrations which promote solubility and the requisite structural integrity for the given application. Generally, the concentration of solidifying agent ranges from about 5 wt-% to 35 wt-%, preferably from about 10 wt-% to 25 wt-%, and most preferably from about 15 wt-% to 20 wt-%.

The Polymeric Films

The cleaning system of the invention may also comprise a continuous polymeric film. These films have at least three general functions. First, the films must remain stable even though used with compositions having otherwise unstable actives. In this instance, stability means that the films must not degrade or erode over time when placed in storage even though in contact with highly alkaline solid or liquid compositions, halogens, or other reactive materials. Further, the film remains aqueous soluble or dispersible after extended contact with reactive alkaline chemicals. An additional function of the polymeric film of the present invention is strength. Specifically, films used in accordance with the invention must have sufficient tensile strength to allow their use in the packaging of solid granular, compressed or pelletized, or blocked chemical agents. Additionally, the polymeric films of the invention should have sufficient strength to allow storage and transport after packaging so that the chemical agent is contained within a package of adequate structural integrity.

The films of the present invention preferably provide enough tolerance to aqueous environments to prevent exposure of the detergent composition material to packagers, transporters, or operators in the use of the chemical composition.

Keeping these general functions in mind, any aqueous soluble or dispersible polymeric film may be used which provide adequate stability, strength, and aqueous tolerance in accordance with this invention. However, certain monomers, polymers, copolymers, and polymeric mixtures have been found especially preferable including vinyl alcohol polymers, polymers resulting from alpha, beta unsaturated carboxylic acid monomers, polymers resulting from alkyl or aliphatic esters of alpha, beta unsaturated carboxylic ester monomers, oxyalkylene polymers and copolymers.

A. Polyvinyl Alcohols and Acetates

Polymeric vinyl alcohol or polyvinyl alcohol (PVOH), is a polyhydroxy polymer having a polymethylene backbone with pendent hydroxy groups. PVOH is a water soluble synthetic resin. It is produced by the hydrolysis of polyvinyl acetate. The theoretical monomer

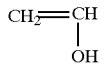

does not exist. Polyvinyl alcohol is one of the very few high molecular weight commercial polymers that is water soluble. It is commonly available as a dry solid and is available in granular or powder form. PVOH grades include a "super" hydrolyzed form (99.3%+ removal of the acetate groups), a fully hydrolyzed form (99%+ removal of the acetate groups), a form of intermediate hydrolysis (about 98 to 91% removal of the acetate groups), and partially hydrolyzed (about 91 to 85% removal of the acetate groups) polyvinyl alcohol.

The properties of the resins vary according to the molecular weight of the parent polymer and the degree of hydrolysis. Polyvinyl alcohols are commonly produced in nominal number average molecular weights that range from about 20,000 to about 200,000. Commonly, the molecular weight of the commercial polyvinyl alcohol grades is reflected in the viscosity of a 4 wt-% solution measured in centipoise (cP) at 20° C. with a Brookfield viscometer. The viscosity of a 4% solution can range from about 5 to about 65 cP. Variation in film flexibility, water sensitivity, ease of solvation, viscosity, block resistance, adhesive strength, dispersing power, can all be varied by adjusting the molecular weight or degree of hydrolysis.

Solutions of polyvinyl alcohol in water can be made. with large quantities of lower alcoholic cosolvents and salt cosolutes. Polyvinyl alcohol can react with aldehydes to form acetals, can be reacted with acrylonitrile to form cyanoethyl groups, and can be reacted with ethylene and. propylene oxide to form hydroxy alkaline groups. Polyvinyl alcohols can be readily crosslinked and can be borated to effect gelation.

Polyvinyl alcohol is made by first forming polyvinyl acetate or vinyl acetate containing copolymer such as an ethylene vinyl acetate copolymer and removing the acetate groups using a base catalyzed alkanolysis. The production of polyvinyl acetate or a vinyl acetate copolymer can be done by conventional processes which control the ultimate molecular weight. Catalyst selection, temperatures, solvent selection and chain transfer agents can be used by persons skilled in the art to control molecular weight. The degree of hydrolysis is controlled by preventing the completion of the alkanolysis reaction.

B. Unsaturated Carboxylic Acids and Esters

The polymeric films of the invention may also result from the polymerization or copolymerization of monomeric alpha, beta unsaturated carboxylic acid or monomeric esters of alpha, beta unsaturated carboxylic acid. Suitable monomers include those containing a carboxylic acid or carboxylate group as a functional group and include a vinyl monomer having a free carboxylic acid or carboxylate functional group. Preferred carboxylic acid containing vinyl monomers for use in this invention comprises for example, 1,4-vinyl benzoic acid, vinyl alcohol esters of dicarboxylic acids, alpha, beta unsaturated carboxylic acids and dicarboxylic acids, and others.

The most preferred carboxylic acid containing monomers comprises alpha, beta unsaturated carboxylic acids including methacrylic acid, acrylic acid, itaconic acid, iconatic acid, cinnamic acid, crotonic acid, mesaconic acid, carboxyethyl acrylic acid, maleic acid, fumaric acid, and the like.

Also useful in the synthesis of an acrylic copolymeric film useful in this invention include esters of alpha, beta unsaturated carboxylic acid such as methacrylic acid, acrylic acid, itaconic acid, iconatic acid, cinnamic acid, crotonic acid, mesaconic acid, carboxyethyl acrylic acid, maleic acid, fumaric acid, and the like. Alkyl esters of alpha, beta unsaturated carboxylic acids can be used in combination with the alpha, beta unsaturated carboxylic acid containing monomers mentioned above.

The alkyl esters may be selected from higher (alkyl) esters such as those of about 5–22 carbon atoms. Examples of $C_{5-22}$ compounds include hexyl, octyl, ethyl (hexyl), isodecyl, and lauryl, acrylates and methacrylates and itaconates. Alkyl esters having branched as opposed to straight chain moieties are also useful in the present copolymers.

Polymer films resulting from these monomers can be prepared by carrying out the polymerization of the mixture of monomer and solvent or solvent mixture such as those processes known to those of skill in the art.

C. Ethylene Oxides Resins

An additional family of monomers which has been found useful in producing the copolymer film of the present invention are the polymeric ethylene oxide. Generally, ethylene oxide has the formula:

$$H(OCH_2CH_2)_nOH.$$

Polyethylene oxides are generally clear viscous liquids, or depending on molecular weight and moles of ethylene oxide, white solids which dissolve in water forming transparent solutions. Polyethylene oxide is soluble in many organic solvents and readily soluble in aromatic hydrocarbons while only slightly soluble in aliphatic hydrocarbons. Polyethylene oxides are generally classified not only by moles of ethylene oxide present within the composition, but also by molecular weight.

D. Preferred Films

In preparing the polymeric film of the present invention, we have found that certain polymers, and polymeric blends are especially preferable. Generally, the polymeric film of the present invention may be single layer or multi-layer. If single layer, the film of the invention most preferably comprises ethyl acrylate-acrylic acid copolymer made from resins such as Belland 2620®. Polyvinyl alcohols and acetate may also be useful as single layer films such as Air Products Vinex® 1000 or 2000 series, and CrisCraft's 7000 or 8000 casted film series.

If multi-layer, the polymeric film of the invention may have any variety of constituencies depending upon the given application. Generally, the most preferred films are three layer films and two layer films. Commercial resins or cast films useful in the present invention include Air Products Vinex® 1000 or 2000 series, polyvinyl alcohol, polyoxyethylene blends made from Union Carbides Polyox® WPRA 3154 resins and Vinex® resins. Both two layer and three layer films made in accordance with this invention have an inner layer which is alkali stable.

i. The Inner Layer

Preferably, this stable inner layer comprises a copolymer of monomeric alpha, beta unsaturated carboxylic acid and monomeric alkyl esters of an alpha, beta unsaturated carboxylic acid.

This copolymeric blend provides stability in reactive environments allowing extended storage prior to use without operator exposure of the packaged material. Additionally, this copolymer does not break down or degrade so as to become nonaqueous soluble or dispersible. Preferred resins include those made by Belland such as the Belland 2620® resin which provides heightened stability to reactive environments such as high pH environments.

The inner layer may also comprise a polymeric mixture of polyvinyl alcohol and polyoxyethylene. Partially hydrolyzed polyvinyl alcohol has been found to be the most useful in this polymeric mixture having a level of hydrolysis ranging from 80% to 90%, preferably from about 83% to 89%, and most preferably from about 87% to 89%. Preferred resins include those sold by Air Products Co. and most specifically, the Vinex® 2000 series include 2034, 2134, and 2144. The polymeric blend also generally comprises polyoxyethylene such as those available from Union Carbide including the Polyox® WRPA 3154 resins. These compositions have been found to provide the highest degree of stability along with maximum tensile strength in this inner layer of the multi-layer polymeric film.

ii. The Intermediate Layer

The intermediate layer of a multi-layer film has most preferably been found to comprise a partially hydrolyzed polyvinyl alcohol. This layer is intended to provide the multi-layer polymeric film with suitable tensile strength so that the film may withstand processing stresses and those physical stresses encountered in transport and application of the system. Generally, the level of hydrolysis in the partially hydrolyzed polyvinyl alcohol will range from about 80% to 90%, preferably from about 83% to 89%, and most preferably from about 87% to 89%. Preferred resins include the Vinex® 2000 series from Air Products Company.

iii. The Outer Layer

Applicants have also found that the optional application of an outer layer comprising a fully hydrolyzed polyvinyl alcohol having a level of hydrolysis of at least 95% and generally ranging from 96% to 99.5%, preferably from about 97% to 99%, and most preferably from about 98% to 99% provides the most suitable protection from premature dissolution of the film and exposure of the highly alkaline material to operators, transporters, or packagers. Preferred films include those made from Air Products resins such as Vinex® 1003.

E. System Fabrication

Films used with the system of the invention may be formed around the cleaning detergents through any variety of means known to those of skill in the art. Processes useful in forming the polymeric film over the cleaning composition of the present invention include melt forming processes such as calendaring or extrusion including blown bubble, slot dye casting, and coating on a substrate; solution forming chemical regeneration methods, emulsion forming, and powder forming.

Generally, preferred methods of forming the film over the solid block include co-casting, coextrusion, extrusion laminating and blown extension. While the initial films may have any variety of thickness, the resulting films generally have a thickness ranging from about 1 mil to about 15 mil, preferably from about 1 mil to 6 mil, and most preferably from about 1 mil to 3 mil. These film thicknesses have been found to provide the best protection to operator and handler along with providing optimal solubility when placed in their use application. Generally, the films will most preferably solubilize at temperatures ranging from about 140° F. to 180° F., preferably from about 140° F. to 160° F., and most preferably from about 140° F. to 150° F., if multi-layer. If single layer, the films may solubilize at temperatures ranging from about 100° F. to 140° F., preferably from about 100° F. to 130° F., and most preferably about 100° F. to 120° F.

Applications

Generally, the present invention provides a two component system which may be dispensed as a single unit in one dispenser or separated and dispensed in more than one dispenser.

Any number of applications may be served by the invention. For example, warewashing applications, laundry applications, institutional sanitizing and floor cleaning operations, food processing environments, health care environments, adult and child care environments, and any other environment which requires some type of chemical treatment in order to clean, sanitize, disinfect, rinse, or otherwise protect a contact sensitive surface.

Generally, the bar and the insert may comprise the same active agent at different concentrations, may comprise different active agents which are compatible, or may comprise different active agents which are either chemically or functionally incompatible.

Examples of systems where the bar and the insert comprise the same active include warewashing systems having an alkaline active and a sequestrant or builder to condition water. In this instance, the outer bar may comprise a moderate amount of alkalinity and water softening capability while the insert comprises capability to provide increased alkalinity and sequestrant ability in order to address heavier soils and hard water applications.

A laundry detergent may be made along the same lines where the outer bar comprises a moderate amount of alkalinity with a surfactant and a sequestrant. Inclusion of the insert will increase the amount of water softening ability for applications having hard water along with providing an increased concentration of surfactant to remove heavier soiling. In warewashing and laundry operations where it is desirable to use a bleach, the outer bar may comprise a detergent including alkali, sequestrant, and surfactant along with a bleach activator. In the meantime, the insert may comprise a peroxygen type bleach for color sensitive fabrics or, for noncolor sensitive fabrics a halogen based bleach such as an chlorine or bromine containing compound.

For applications where the bar and insert are different but chemically and functionally compatible, the outer bar may comprise a detergent including alkali, surfactant, and sequestering agent while the insert may include an enzyme booster for removing protein based soils such as bloods, food soils, and the like.

The present invention is also useful for systems where the bar and the insert comprise functionally in compatible active ingredients. In this instance, the invention may be delivered in one package and the outer bar, for example, comprising a detergent separated from the insert which comprises a sanitizer. In this instance, the detergent may be placed in the dispenser at one end of a dishwashing machine while the sanitizer is placed in a dispenser at the opposite end of the dishwashing machine. Similarly, detergents and rinse additives may be complementarily packaged.

Presoaks and detergents may also be packaged in this manner wherein the presoak and detergent are separated prior to their application. Oftentimes, presoaks are literally used to free residue from pots, pans and flatware in one sink while detergents are used in a second or third sink after rinsing to clean the residue remaining on the dishes. In this instance, while the two compositions are not used together, the invention does allow for complementary packaging prior to use.

An additional example of the application of the invention include the complementary packaging of floor cleaners and hard surface cleaners for countertops, ranges and the like. In this instance, floor cleaners tend to have a high pH or high alkali content while hard surface cleaners tend to retain a lower alkali content due to their contact surface criticality.

One of many further examples includes the use of an alkaline detergent comprising an encapsulated bleach in the form of a bar. The insert may contain a souring or neutralizing agent used to drop the pH of the system so that the bleach may act after the detergent has completed the intended action. In this instance, the bar and insert will be applied to the system as one unit and the insert will comprise a hardener having a higher degree of water insolubility such as an organic, for example, an amide or a nonionic surfactant while the bar will retain a hardener which is more aqueous soluble.

After the bar is dissolved and the detergent is released to function, the encapsulated bleach will be retained in the system. Once the detergent has completed its action, the encapsulated bleach which is now beginning to dissolve will dissolve coincidentally with the insert containing the souring agent thereby lowering the pH and effectively altering the environment of use so that the bleach can remain effective.

WORKING EXAMPLES

Following below are formulatory working examples using the composition of the invention. While the invention is exemplified by the working examples, it is not limited to the examples shown hereinafter.

Working Example 1

A detergent (bar), rinse aid (insert) composition may be formulated in accordance with the invention. Each product is produced separately in the appropriate molds. The following ingredients are combined in such a way as to render them a solid detergent block at the end of the manufacturing procedure. The detergent solid comprises 45% sodium hydroxide, 35% builder (sodium tripolyphosphate), 5% sodium polyacrylate, 3% nonionic surfactant (ECOLAB LF428—benzyl ether of a polyethoxylated (12 moles EO) linear alcohol ($C_{12-14}$)).

The rinse aid solid comprises 59% (Ecolab LF 428—described above), 8% solid nonionic surfactant (BASF Pluronic F87—EO/PO block polymer 114 moles EO/39 moles PO, avg mol wt 7700), 16% hydrotrope—anionic surfactant (Ecolab NAS—sodium octyl sulfonate) 16% solidification agent (PEG 8000 polyethylene glycol—Union Carbide Carbowax 8000—avg mol wt 7000–9000). The detergent formulation is preformed into the appropriate shape in a processing mold. Upon solidification, the solid block is placed in the water soluble container. Extrusion technology allows us to go directly into the water soluble container without an intermediate molding step or an additional cooling step.

Once formed, the pieces are then individually wrapped in water soluble packaging. The packaging is preformed (thermoformed) in the appropriate size and shape. The combination of these two pieces is over wrapped with a non-water soluble film. This non-water soluble film provides the moisture barrier necessary for shelf storage and transportation. At the point. of use, the over wrap is removed and the two individually wrapped pieces are placed in their respective dispensers. The water soluble film wrapping protects the end user from having direct chemical contact with the product.

Working Example 2

This combination of compositions represents a laundry detergent which is formulated to address situations with soft to medium grain hardness water (0–5 gpg) and light to medium soil loads. The bar is the detergent. The insert provides additional chemicals to the original formulation that allow its use over a broader range of water conditions as well as soil loads.

The bar and insert are manufactured independently. The bar and insert are made by delivering the chemicals to molds of the appropriate size and shape. Since no chemical incompatibility exists, the two pieces are placed together in a single water soluble overwrap or preformed container. This outer wrap prevents operator contact with the chemicals. Both of the bar and insert are placed in the same dispenser. The rate of dissolution of the product and its delivery to the end site are controlled through the formulation.

The laundry detergent comprises 18% solidification agent (polyethylene glycol avg mol wt 7000–9000 Union Carbide Carbowax 8000), 33% nonionic surfactant (Ecolab NPE 9.5 polyethylene glycol ether of nonyl phenol –9.5 moles of EO), 27% builder (sodium tripolyphosphate), 15% alkalinity source (sodium metasilicate) with the remainder as $H_2O$.

The insert booster would be a preformed solid of 35% of a solidification agent (PEG 8000 polyethylene glycol 8000 mw), 55% sodium tripolyphosphate, and 10% sodium polyacrylate.

Working Example 3

The bar is a rinse aid that provides the standard performance properties of sheeting and film removal. The insert allows for destaining as coffee and tea stains are generally not removed by conventional rinse additives.

In this system, the two solids are preformed and then wrapped together with water soluble film. This approach, like the water conditioning booster, allows for flexibility in use and manufacturing.

The solid rinse aid comprises 16% a solidification agent (PEG 8000), 17% anionic surfactant which functions as a hydrotrope (sodium xylene sulfonate), 3% nonionic surfactant which functions as a defoaming agent (Pluronic 25R2 BASF PO/EO/PO block polymer avg mol wt 3100), 20% solid nonionic surfactant which helps solidification as well as providing actives (Pluronic 25R8 BASF PO/EO/PO block polymer avg mol wt 9000), 20% nonionic surfactant (Pluronic L43 BASF EO/PO/EO block polymer avg mol wt 1800) and 23% nonionic surfactant (Pluronic L62 BASF EO/PO/EO block polymer avg mol wt 2400) with the remainder water.

The insert comprises a solid destaining agent of 35% solidification agent (PEG 8000), 20% builder (sodium tripolyphosphate) and 45% encapsulated chlorine source (sodium dichloroisocyanurate dihydrate). The encapsulating materials provide a multilayer coating that isolates the active chlorine source from contact with organics during processing and storage.

Working Example 4

A pot and pan detergent and third sink sanitizer may also be formulated in accordance in the invention.

Both bar and insert are preformed and placed into separate water soluble containers. Extrusion technology allows for the pot and pan detergents to be extruded directly into a preformed water soluble container. The two individually wrapped pieces are over wrapped with a non-water soluble film. This package provides the moisture barrier necessary for transportation and storage. The two pieces are separated at the use site and placed in two separate dispenser cavities.

The pot and pan solid detergent comprises 20% of a solidification agent (PEG 8000), 8% caustic solution (50% active), 15% anionic surfactant (sodium lauryl ether ethoxylate sulfate Stepan Steol-CS-460), 7% sodium acetate, 11% lauric monoethanolamide (surfactant), 9% coconut dimethylamine propylamide, 3% hydrogen peroxide, 35% combination of lauric monoethanolamide and hydrogen peroxide resulting in an amine oxide surfactant. The remainder is sulfonic acid, water, dye, and fragrance.

The insert comprises 35% solidification agent (PEG 8000), 15% nonionic surfactant (Pluronic L62 BASF EO/PO/EO block polymer), and 50% encapsulated chlorine source.

Working Example 5

An enzyme containing laundry detergent may also be formulated in accordance with the invention.

Both bar and insert are preformed and placed into separate water soluble containers. Extrusion technology allows for the pot and pan detergents to be extruded directed into a preformed water soluble container. The two individually wrapped pieces are overwrapped with a non-water soluble film. This package provides the moisture barrier necessary for transportation and storage. The two pieces are separated at the use cite and placed in two separate dispenser cavities. The laundry detergent in the bar generally comprises 10% sodium metasilicate, 10% sodium bicarbonate, 20% polyethylene glycol (8000 mw), 35% nonionic surfactant, 5% anionic surfactant such as sodium orthosulfate, 15% citric acid and 5% water. The composition may also contain dye, fragrance, optical brighteners, and anti-redeposition agents.

The insert section of the composition may comprise 35% polyethylene glycol (8000 mw), 15% enzymes including 6% amylase, 6% protease, and 3% cellulose, 30% sodium bicarbonate, and 20% citric acid.

The above specification, examples and data provided complete description of the manufacture and use of the system of the invention. Since many embodiments of the invention can be made without departing from the spirit and scope of the invention, the invention resides in the claims hereinafter appended.

We claim as our invention:

1. A cast cleaning system which may be dispensed by the application of an aqueous spray, said cleaning system comprising a first part and a second part, said system first part comprising a detergent and said system second part comprising a rinse additive, wherein said first and second system parts are fabricated as one solid, said system first and second parts comprising respective first and second shapes, said second shape fitting into said first shape to provide at least one surface for contact by aqueous spray, wherein said detergent comprises a first nonionic surfactant and said rinse additive comprises a second nonionic surfactant, and wherein the concentration of said first nonionic surfacant is smaller as a proportion of the detergent than the concentration of said second nonionic surfactant as a proportion of said rinse additive.

2. The cleaning system of claim 1, wherein said first and second nonionic surfactants are the same.

3. A cast cleaning system which may be dispensed by the application of an aqueous spray, said cleaning system comprising a first part and a second part, said system first part comprising a detergent and said system second part comprising a rinse additive, wherein said first and second system parts are fabricated as one solid, said system first and second parts comprising respective first and second shapes, said second shape fitting into said first shape to provide at least one surface for contact by aqueous spray, wherein said first and said second parts have a sequestrant, wherein said sequestrant is chosen from salts of amino carboxylic acids, wherein said amino carboxylic acids are chosen from n-hydroxyethyliminodiacetic acid, nitrilotriacetic acid, ethylenediaminetetraacetic acid, hydroxyethylethylenediaminetriacetic acid, diethylenetriaminepentaacetic acid, or combinations thereof.

4. The cast cleaning system of claim 3, herein said amino carboxylic acids have a concentration of from about 1 wt-% to 25 wt-%.

5. The cast cleaning system of claim 4, wherein said amino carboxylic acids have a concentration of from about 5 wt-% to 20 wt-%.

6. The cast cleaning system of claim 5, wherein said amino carboxylic acids have a concentration of from about 10 wt-% to 15 wt-%.

7. A cast cleaning system which may be dispensed by the application of an aqueous spray, said cleaning system comprising a first part and a second part, said system first part comprising a detergent and said system second part comprising a rinse additive, wherein said first and second system parts are fabricated as one solid, said system first and second parts comprising respective first and second shapes, said second shape fitting into said first shape to provide at least one surface for contact by aqueous spray, wherein said first and said second parts have an enzyme, wherein said enzyme is chosen from proteases, amylases, cellulases, lipases, phospholipases, redox enzymes, isomerases, or combinations thereof.

8. The cast cleaning system of claim 7, wherein said enzymes have a concentration of from about 2 wt-% to 25 wt-%.

9. The cast cleaning system of claim 8, wherein said enzymes have a concentration of from about 5 wt-% to 20 wt-%.

10. The cast cleaning system of claim 9, wherein said enzymes have a concentration of from about 10 wt-% to 15 wt-%.

11. A cast cleaning system which may be dispensed by the application of an aqueous spray, said cleaning system comprising a first part and a second part, said system first part comprising a detergent and said system second part comprising a rinse additive, wherein said first and second system parts are fabricated as one solid, said system first and second parts comprising respective first and second shapes, said second shape fitting into said fist shape to provide at least one surface for contact by aqueous spray, wherein said first and said second parts have an antimicrobial agent seleted from the group consisting of aldehydes, idophors, phenolics, anionic surfactants, cationic surfactants, inorganic chlorine releasing agents, organic chlorine releasing agents, or combinations thereof.

12. The cast cleaning system of claim 11, wherein said antimicrobial agent has a concentration of from about 5 wt-% to 70 wt-%.

13. The cast cleaning system of claim 12, wherein said antimicrobial agents have a concentration of from about 10 wt-% to 50 wt-%.

14. The cast cleaning system of claim 13, wherein said antimicrobial agents have a concentration of from about 20 wt-% to 40 wt-%.

* * * * *